US007494101B2

(12) United States Patent
Chen

(10) Patent No.: US 7,494,101 B2
(45) Date of Patent: Feb. 24, 2009

(54) HOOK-ON TYPE RAIL

(75) Inventor: Henry Chen, Taipei (TW)

(73) Assignee: Protrend Co., Ltd, Taipei (TW)

( * ) Notice: Subject to any disclaimer, the term of this patent is extended or adjusted under 35 U.S.C. 154(b) by 341 days.

(21) Appl. No.: 11/207,353

(22) Filed: Aug. 18, 2005

(65) Prior Publication Data

US 2007/0039913 A1 Feb. 22, 2007

(51) Int. Cl.
*A47F 5/00* (2006.01)
*A47H 1/10* (2006.01)

(52) U.S. Cl. ..... 248/298.1; 248/220.31; 248/316.8; 248/287.1; 248/295.11; 312/265.1; 312/265.2; 312/265.3; 312/265.4; 211/192

(58) Field of Classification Search ..... 248/220.31, 248/300, 316.8, 287.1, 298.1, 295.11; 312/334.4, 312/334.5, 223.1, 265.1, 265.2, 265.3, 265.4; 211/192
See application file for complete search history.

(56) References Cited

U.S. PATENT DOCUMENTS 5,039,181 A * 8/1991 Lautenschlager ..... 312/334.7
5,063,715 A * 11/1991 Goodman ..... 52/36.6
5,292,198 A * 3/1994 Rock et al. ..... 384/21
5,439,283 A * 8/1995 Schroder et al. ..... 312/334.4
5,487,525 A * 1/1996 Drabczyk et al. ..... 248/639
5,538,213 A * 7/1996 Brown ..... 248/222.11
5,730,514 A * 3/1998 Hashemi ..... 312/333
5,833,337 A * 11/1998 Kofstad ..... 312/334.5
5,836,562 A * 11/1998 Danzyger et al. ..... 248/295.11
5,895,020 A * 4/1999 Danzyger et al. ..... 248/295.11
6,422,399 B1 * 7/2002 Castillo et al. ..... 211/26
6,615,993 B1 * 9/2003 Rudiger ..... 211/26
6,666,340 B2 * 12/2003 Basinger et al. ..... 211/26
6,702,412 B2 * 3/2004 Dobler et al. ..... 312/334.5
6,773,080 B2 * 8/2004 Chen et al. ..... 312/265.1
6,923,518 B2 * 8/2005 Kim ..... 312/334.4
6,926,378 B2 * 8/2005 Greenwald et al. ..... 312/334.4
6,929,339 B1 * 8/2005 Greenwald et al. ..... 312/334.4
2005/0156493 A1 * 7/2005 Yang et al. ..... 312/334.5
2006/0000961 A1 * 1/2006 Wei-Chieh et al. ..... 248/223.41

* cited by examiner

*Primary Examiner*—J. Allen Shriver, II
*Assistant Examiner*—Michael McDuffie
(74) *Attorney, Agent, or Firm*—WPAT. P.C.; Justin King

(57) ABSTRACT

A hook-on type rail includes a main body, a front hooking member adjustably connected to a rear end of the main body, and a second hooking member adjustably connected to a front end of the main body. The first hooking member has two sideward projected hooks for firmly located in two insertion holes on a rear post of a sectional rack. The second hooking member includes two sideward projected lugs for fitly inserting into two insertion holes on a front post of the sectional rack to prevent the rail from moving up or down, and two vertically movable hooks bearing against one side of the two lugs for extending into and hooking on the same insertion holes to firmly hold the rail to the front post. Therefore, the rail may be stably hooked on the posts of the sectional rack for a drawer or the like to safely slide thereon.

4 Claims, 4 Drawing Sheets

HOOK-ON TYPE RAIL

FIELD OF THE INVENTION

The present invention relates to a hook-on type rail, and more particularly to a rail that could be conveniently and stably hooked on vertical posts of a sectional rack for a drawer or the like to safely slide thereon.

BACKGROUND OF THE INVENTION

A metal rack would be more useful when it is provided with one or more drawers or slidable baskets in addition to the normally included horizontal shelves. In the early stage, rails are directly welded to the posts of the metal rack. As a result, the metal rack could not be disassembled to occupy a big room, and is not easily movable.

Currently, there are various types of sectional racks available in the market. Most of these sectional racks include vertical posts and horizontal shelves. Among others, there is a sectional rack using cone-shaped sleeves to connect the shelves to the vertical posts. When it is desired to mount a rail on the sectional rack, first weld two cone-shaped sleeves front and rear ends of the rail, and then connect each end of the rail to one post via a cone-shaped lining provided on the post. The gross weight of the rail and the drawer supported on the rail pulls the cone-shaped sleeves downward to tightly press against the cone-shaped lining, so that the rail is firmly fixed on the posts. However, when the drawer is pulled outward, there is a relatively large load on a front section of the rail and a relatively small load on a rear section of the rail, resulting in a lifted rear end of the rail and accordingly, a rail deviated from a desired horizontal position.

There is still another type of sectional rack having posts provided with insertion holes. Shelves or hangers may be fixed on the posts via hooks inserted into and located in the insertion holes. A rail for mounting on the rack is provided at an outer side with hooks, which are extended through the insertion holes and then moved downward to hook on the posts. However, since there is always a considerably large gap left between an upper end of the hooks on the rail and an upper edge of the insertion holes, the rail tends to move upward and downward relative to the posts, and is therefore not ideal for use.

SUMMARY OF THE INVENTION

A primary object of the present invention is to provide a hook-on type rail that could be stably hooked on posts provided with insertion holes without the risk of separating from the posts.

Another object of the present invention is to provide a hook-on type rail that includes front and rear hooking members adjustably connected to front and rear ends thereof, so that errors in the size of posts, to which the rail is mounted, could be compensated for the rail to always locate at a horizontal position.

To achieve the above and other objects, the hook-on type rail of the present invention includes a main body, a front hooking member adjustably connected to a rear outer end of the main body, and a second hooking member adjustably connected to a front outer end of the main body. The first hooking member has two sideward projected L-shaped hooks for firmly located in two insertion holes on a rear post of a sectional rack. The second hooking member includes two sideward projected lugs for fitly inserting into two insertion holes on a front post of the sectional rack to prevent the rail from moving up or down, and two vertically movable hooks bearing against one side of the two lugs for extending into and hooking on the same insertion holes to firmly hold the rail to the front post. Therefore, the rail may be stably hooked on the posts of the sectional rack for a drawer or the like to safely slide thereon.

The lugs on the second hooking member have a height similar to that of the insertion holes on the front post, enabling the lugs inserted into the insertion holes to prevent the rail from moving up or down.

The two vertically slidable hooks on the second hooking member have a height smaller than that of the two lugs, such that upper and lower ends of each slidable hook do not project from upper and lower ends of a corresponding lug when the hook is fully slid upward. And, when the slidable hooks are moved downward, they are adapted to hook on the insertion holes to firmly connect the front end of the rail to the front post.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
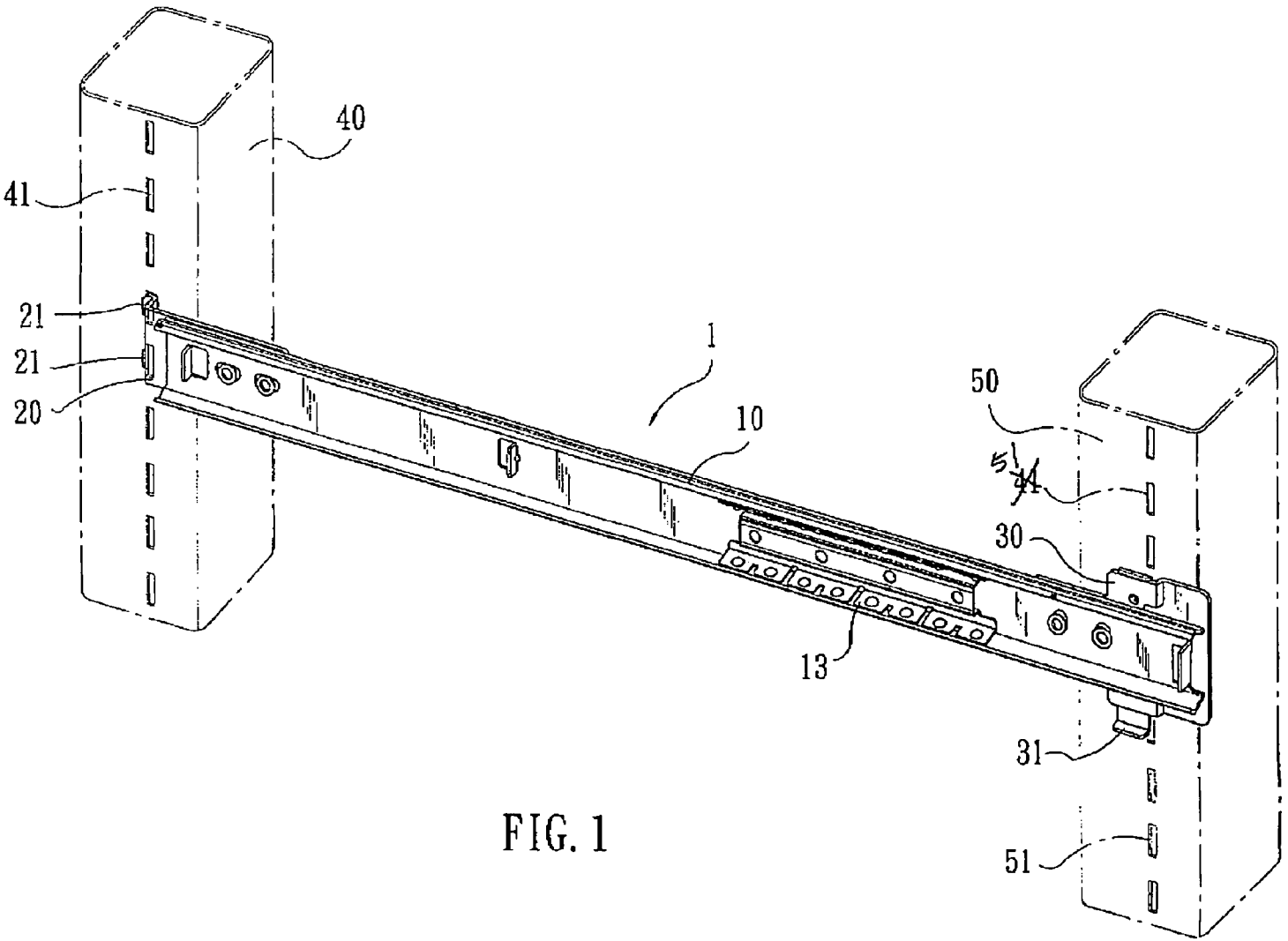
FIG. 1 is a perspective view of a hook-on type rail according to an embodiment of the present invention.
Figure 2:
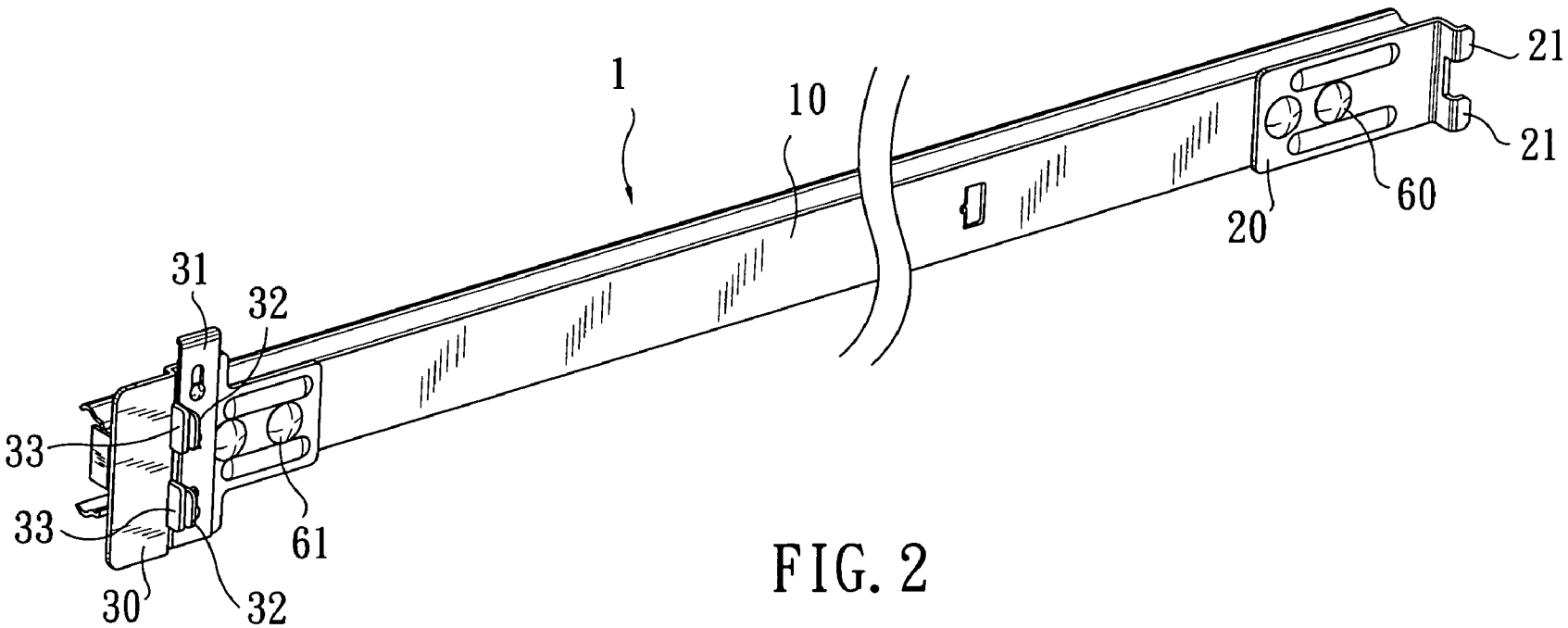
FIG. 2 shows the hook-on type rail of FIG. 1 from an outer side thereof.
Figure 3:
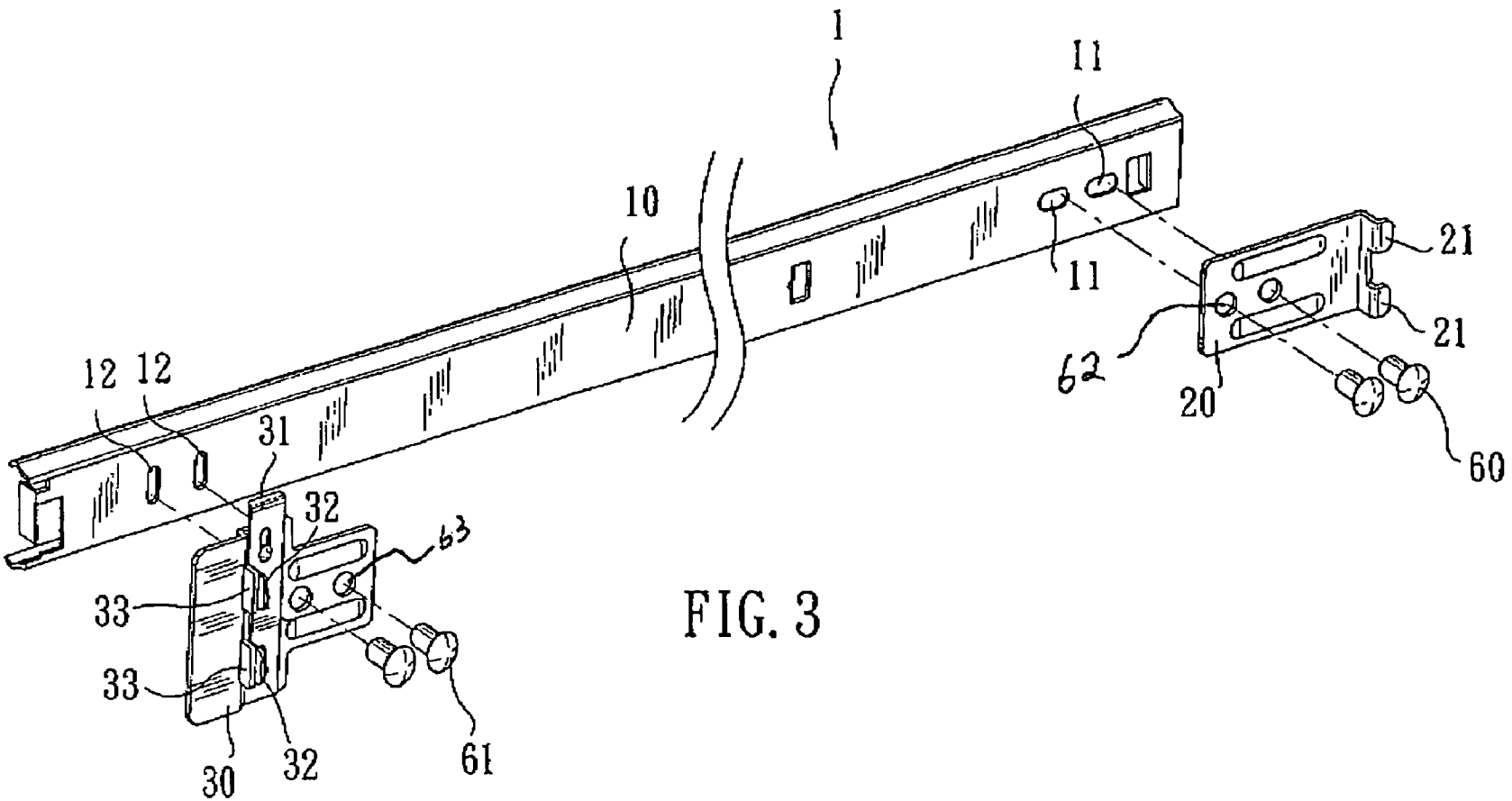
FIG. 3 is an exploded perspective view of the hook-on type rail of FIG. 1 viewed from an outer side thereof.

Please refer to FIGS. 1 to 3, in which a hook-on type rail 1 according to an embodiment of the present invention is shown. As shown, the rail 1 includes a main body 10, a first hooking member 20 adjustably attached to a rear outer end of the main body 10, and a second hooking member 30 adjustably attached to a front outer end of the main body 10.

The first hooking member 20 has a rear end formed into two vertically spaced and horizontally extended L-shaped hooks 21. The first hooking member 20 is mounted on the rail 1 with the two hooks 21 projected from the rear end of the main body 10.

The second hooking member 30 has a slide plate 31 vertically movably associated therewith. The slide plate 31 is formed at a front edge with two vertically spaced and downward extended hooks 32.

The rail 1 may be detachably connected at the rear end to a rear vertical post 40 of a sectional rack by inserting the two L-shaped hooks 21 of the first hooking member 20 into two vertically adjacent insertion holes 41 provided on an inner side of the rear vertical post 40. Thereafter, the rail 1 is moved to bear an outer side thereof against the inner side of the rear vertical post 40, bringing the ends of the L-shaped hooks 21 to abut on an inner wall surface of the post 40 without the risk of separating from the insertion holes 41, such that the rear end of the rail 1 is firmly fixed to the post 40.

Figure 5:
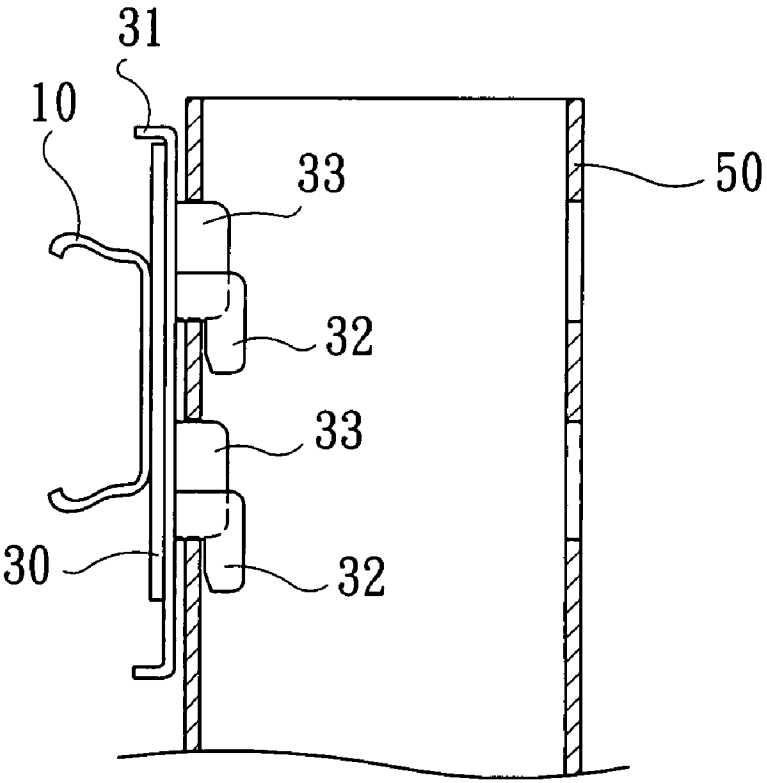
FIGS. 4 and 5 are sectioned side views showing the connection of a front end of the hook-on type rail of FIG. 1 to a front vertical post of a sectional rack.
Figure 4:
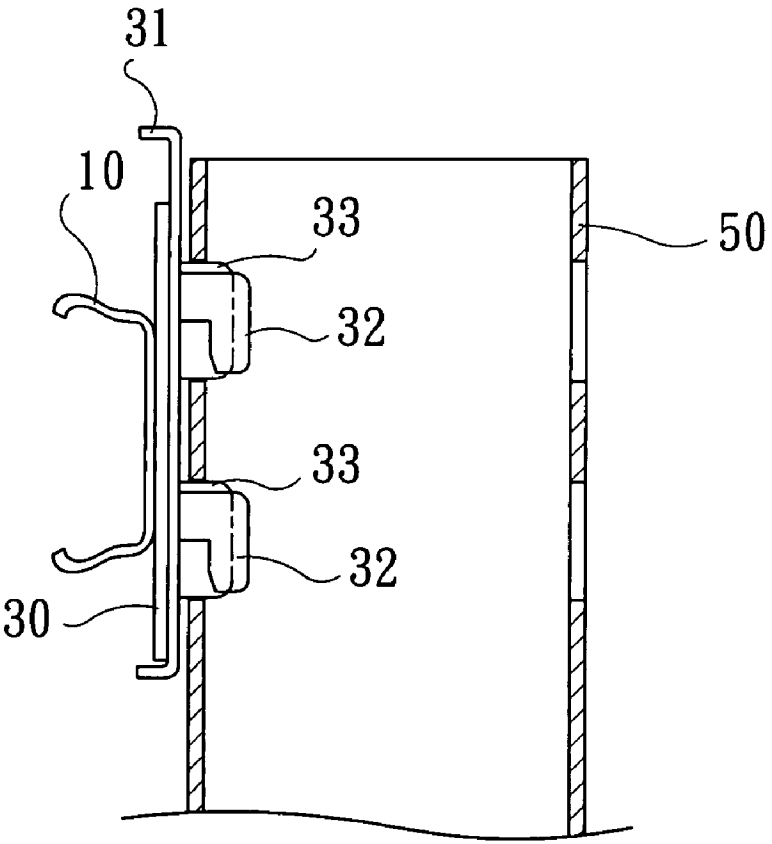

The second hooking member 30 is provided at predetermined positions with two vertically spaced lugs 33, which separately bear against an outer side of the two hooks 32 on the slide plate 31. When the slide plate 31 is fully slid upward relative to the second hooking member 30, upper and lower ends of each of the two hooks 32 are not projected from upper and lower ends of the corresponding lug 33. When the rail 1 is moved to completely bear against the inner side of the rear vertical post 40, the two lugs 33 and the two hooks 32 are simultaneously inserted into two vertically adjacent insertion holes 51 provided on an inner side of a front vertical post 50 of the sectional rack, bringing the front end of the rail 1 to locate at a fixed position without the possibility of moving upward or downward relative to the insertion holes 51, as shown in FIG. 4. At this point, the slide plate 31 may be slid downward to move the two hooks 32 downward at the same time, so that the two hooks 32 hook on the insertion holes 51 to firmly connect the front end of the rail 1 to the front vertical post 50, as shown in FIG. 5.

FIG. 3 also shows that the rear outer end of the main body 10 has a pair of horizontally extended long holes 11 formed on the main body 10, and the first hooking member 20 has a pair of corresponding generally round holes 62 formed on the first hooking member 20, such that the first hooking member 20 is affixed to the rear outer end of the main body 10 with a pair of rivets 60 in a horizontally adjustable manner. The front outer end of the main body 10 has a pair of vertically extended long holes 12 formed on the main body, and the second hooking member 30 has a pair of corresponding generally round holes 63 formed on the second hooking member 30, such that the second hooking member 30 is affixed to the front outer end of the main body 10 with a pair of rivets 61 in a vertically adjustable manner.

The sectional rack using four vertical posts 40, 50 as its supporting posts includes a plurality of shelves (not shown), each of which are connected at four corners to the four vertical posts 40, 50 to complete the rack. It is possible the shelves have some errors in size to therefore produce errors in the distances between the front and the rear vertical posts 50, 40. Please refer to FIG. 3. To compensate these errors in size, the first hooking member 20 is connected to the rear end of the main body 10 of the rail 1 by extending rivets 60 through horizontally extended long holes 11 formed on the main body 10, so that the first hooking member 20 may be moved forward or rearward relative to the rail main body 10 to eliminate the error in the distance between the rear and the front post 40, 50. Similarly, the second hooking member 30 is connected to the front end of the rail main body 10 by extending rivets 61 through vertically extended long holes 12 formed on the rail main body 10, so that the second hooking member 30 may be slightly moved upward or downward relative to the rail main body 10 to eliminate the difference between the heights of the insertion holes 41, 51 on the rear and the front post 40, 50.

An inner side of the rail 1 defines a path for a drawer (not shown). In the illustrated embodiment of the present invention, the rail 1 is provided at the inner side with a sliding guide 13, which is connected to one side of a drawer to guide the same to smoothly slide on the rail 1.

With the two lugs 33 fitly inserted in the two insertion holes 51 on the front vertical post 50, the rail 1 is firmly connected at the front end to the front vertical post 50 without moving upward or downward, enabling the rail 1 to be stably mounted on the section rack. And, with the hooks 32 firmly hooked on the insertion holes 51, the rail 1 is safely connected to the post 50 without the risk of separating therefrom. Therefore, the hook-on rail of the present invention is very ideal for use with a sectional rack.

What is claimed is:

1. A hook-on type rail, comprising:

a main body defining at an inner side a path for a drawer-like object to slide on said rail;

a first hooking member for connecting to a rear outer end of said main body and having a rear end formed into at least one horizontally extended L-shaped hook, and said L-shaped hook having a rear end rearward projected from the rear end of the main body; and a second hooking member for connecting to a front outer end of said main body, said second hooking member being provided at predetermined positions with two vertically spaced lugs, and having a slide plate vertically slidably connected thereto, such that said two lugs on the second hooking member butt against an outer side of two vertically spaced and downwardly extended hooks provided on said slide plate, and each of said two hooks on said slide plate has upper and lower ends that arc not projected from tipper and lower ends of a corresponding lug on said second hooking member when said slide plate is fully slid upward relative to said second hooking member.

2. The hook-on type rail as claimed in claim 1, wherein the rear outer end of said main body has at least one horizontally extended long hole formed on said main body, and said first hooking member has at least one corresponding generally round hole formed on said first hooking member, such that said first hooking member is affixed to the rear outer end of said main body with at least one rivet in a horizontally adjustable manner.

3. The hook-on type rail as claimed in claim 1, wherein the front outer end of said main body has at least one vertically extended long hole formed on said main body, and said second hooking member has at least one corresponding generally round hole formed on said second hooking member such that said second hooking member is affixed to the front outer end of said main body with at least one rivet in a vertically adjustable manner.

4. A hook-on type rail, comprising:

a main body defining at an inner side a path for a drawer-like object to slide on said rail;

a first hooking member for connecting to a rear outer end of said main body and having a rear end formed into at least one horizontally extended L-shaped hook, and said L-shaped hook having a rear end rearward projected from the rear end of the main body; and a second hooking member for connecting to a front outer end of said main body, said second hooking member being provided at predetermined positions with two vertically spaced lugs, and having a slide plate vertically slidably connected thereto, such that said two lugs on the second hooking member butt against an outer side of two vertically spaced and downwardly extended hooks provided on said slide plate, and each of said two books on said slide plate has upper and lower ends that are not protruded from upper and lower ends of a corresponding lug on said second hooking member when said slide plate is fully slid upward relative to said second hooking member;

wherein the rear outer end of said main body has at least one horizontally extended long hole formal on said main body, and said first hooking member has at least one corresponding generally round hole formed on said first hooking member, such that said first hooking member is affixed to the rear outer end of said main body with at least one rivet in a horizontally adjustable manner, and the front outer end of said main body has at least one vertically extended long hole formed on said main body, and said second hooking member has at least one corresponding generally round hole formed on said second hooking member, such that said second hooking member is affixed to the front outer end of said main body with at least one rivet in a vertically adjustable manner.

* * * * *